United States Patent [19]

Quesnel

[11] 4,126,077

[45] Nov. 21, 1978

[54] RECOIL REDUCING SYSTEM FOR RIFLES, GUNS, CANNONS AND THE LIKE

[76] Inventor: Henry R. Quesnel, R.D. #1, Rutland, Vt. 05701

[21] Appl. No.: 760,393

[22] Filed: Jan. 18, 1977

[51] Int. Cl.[2] ..... F41F 3/02

[52] U.S. Cl. ..... 89/1.704; 89/14 R

[58] Field of Search ..... 42/76 R; 89/1 E, 1.7, 89/1.703, 1.704, 1.705, 1.706, 8, 14 R, 14 D, 42 R

[56] References Cited

U.S. PATENT DOCUMENTS

| | | | |
|---|---|---|---|
| 1,469,918 | 10/1923 | De Maine | 89/42 R |
| 3,118,342 | 1/1964 | Campione et al. | 89/1 E |
| 3,457,826 | 7/1969 | Stott | 89/8 |
| 3,730,050 | 5/1973 | Goldin et al. | 89/14 R |

FOREIGN PATENT DOCUMENTS

| | | | |
|---|---|---|---|
| 418,497 | 10/1934 | United Kingdom | 89/42 R |

*Primary Examiner*—Stephen C. Bentley
*Attorney, Agent, or Firm*—Witherspoon, Lane & Hargest

[57] ABSTRACT

A system designed to reduce the recoil of any ball and powder type weapon such as guns, rifles, cannons or the like is disclosed. In a ball and powder type weapon the bullet or shell is propelled out of the barrel by the high pressure created by the explosion of the powder. Not only is the bullet or shell propelled out of the barrel but the air and other hot gasses are also jetted out of the barrel. Due to the fact that the air and other hot gasses are jetted out of the barrel, a vacuum is created in the barrel. After the shell or bullet and the hot gasses are jetted out of the barrel, air from the outside due to atmospheric pressure rushes back into the evacuated barrel and it is this rush of air back into the barrel that is the major cause of recoil in a ball and powder type weapon. The system of this invention reduces the recoil caused by this rush of air back into the barrel by providing a plurality of chambers that communicate with the bore of the weapon through separate channels or ports. A different one of the channels or ports couples each chamber to the bore of the weapon and each channel or port is provided with an adjustable needle valve. When the weapon is fired, some of the gasses in the bore flow into each chamber through the channels. When the bullet or shell exits from the barrel, the gasses in each chamber flow back into the evacuated bore. The gasses flowing back into the bore increase the pressure in the bore and create a cushion in the breech area of the weapon for the air entering the bore from the outside, thereby reducing the recoil of the weapon and the breech noise.

2 Claims, 3 Drawing Figures

RECOIL REDUCING SYSTEM FOR RIFLES, GUNS, CANNONS AND THE LIKE

BACKGROUND OF THE INVENTION

This invention relates to ball and powder type weapons such as guns, rifles, cannons and the like, and more particularly to a system for reducing the recoil of ball and power type weapons such as guns, rifles, cannons and the like.

When a ball and powder type weapon is fired, the bullet or shell is propelled out of the barrel by the high pressure created by the explosion of the powder. Not only is the bullet or shell propelled out of the barrel but the air and other hot gasses are also jetted out of the barrel and a vacuum is created inside the barrel. After the shell or bullet and the hot gasses are jetted out of the barrel, air from the outside due to atmospheric pressure rushes back into the now evacuated barrel. This in-rush of air back into the barrel has an impact greater than the impact caused by the shell or bullet being propelled out of the barrel. Thus, the major cause of recoil in a ball and powder type weapon is not the impact caused by the firing of the weapon but is the impact caused by the rush of air back into the evacuated bore. This fact has been proven by experiment.

This invention provides a system for reducing the recoil caused by air rushing back into the bore of the weapon after it has been fired. Further, the system of this invention reduces the recoil of a ball and powder type weapon without appreciably affecting the velocity and range of the weapon.

SUMMARY OF THE INVENTION

This invention provides a system for reducing the recoil of a ball and powder type weapon such as rifles, guns, cannons and the like. In accordance with this invention, a plurality of chambers surround the barrel of a ball and powder type weapon. The chambers are spaced around the barrel in the breech area of the weapon. A plurality of channels or ports, one associated with each chamber, extend from the chambers into the bore of the weapon such that a separate passageway is formed between each chamber and the bore of the weapon. An adjustable needle valve is associated with each of the channels or ports.

When a ball and powder type weapon is fired, the explosion of the powder creates a high pressure in the weapon to propel the bullet or shell out of the barrel. In addition, the explosion creates heat. There is, of course, an opposite or recoil force caused by the force that propels the bullet or shell out of the barrel. This recoil force is, however, but a small force compared to the recoil caused by air rushing into the barrel after the bullet or shell and hot gasses are propelled out of the barrel. When the ammunition is fired, not only is the projectile propelled out of the barrel, but the hot gasses are also forced out of the barrel and for an instant there is a vacuum created inside the barrel. Due to atmospheric pressure, air rushes into the evacuated barrel and it is the impact of air rushing back into the barrel that is the major cause of recoil in a ball and powder type weapon. Since a vacuum has been formed inside the barrel, there is essentially no resistance to the air flowing back into the barrel and the air, therefore, rushes back into the barrel with considerable velocity and impacts the back of the breech causing the weapon to recoil. The chamber system of this invention reduces the recoil caused by the in-rush of air when a ball and powder type weapon is fired by bleeding gasses back into the bore from the chambers, the gasses being introduced into the chambers when the weapon is fired.

BRIEF DESCRIPTION OF THE DRAWING

A full and complete understanding of the invention can be obtained from the following detailed description when read in conjunction with annexed drawings in which.

DETAILED DESCRIPTION OF THE INVENTION

Figure 1:
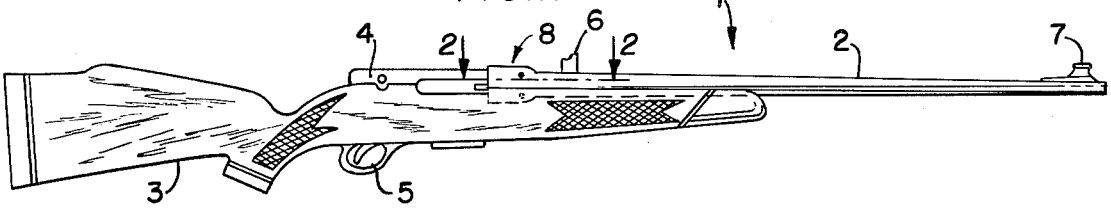
FIG. 1 shows a rifle having the recoil system of this invention.

Referring to FIG. 1 of the drawing, this FIG. shows a rifle 1 that includes the recoil system of this invention. At first glance, rifle 1 appears to be a typical bolt action rifle having a barrel 2, a stock 3, a bolt action 4, a trigger 5, a rear sight 6 and a front sight 7. In addition to the foregoing elements of a conventional rifle, rifle 1 includes the recoil reduction system 8 of this invention. As will become apparent, recoil reduction system 8 is preferably formed as an integral part of rifle 1 during the manufacture of the rifle but can however be added to an existing rifle. Further, as will become apparent, recoil reduction system 8 can be incorporated into any ball and powder type weapon such as a rifle, gun, cannon or the like to reduce the recoil of the weapon.

Figure 2:
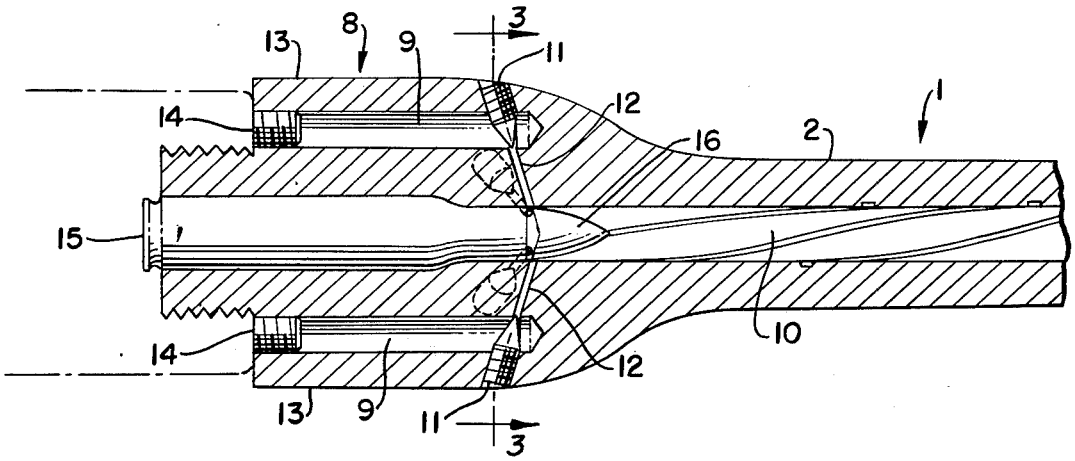
FIG. 2 which is a fragmentary cross-sectional view of the rifle of FIG. 1 taken along the line 2—2 of FIG. 1 shows the structural details of the preferred embodiment of this invention.
Figure 3:
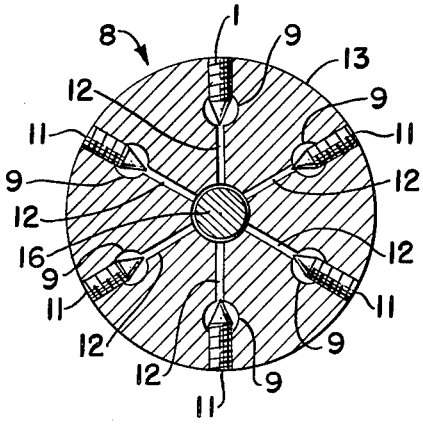
FIG. 3 which is a cross-sectional view taken along the line 3—3 shows a typical chamber arrangement of the preferred embodiment of this invention.

FIG. 2 which is a fragmentary cross-section view of rifle 1 taken along the line 2—2 of FIG. 1 and FIG. 3 which is a cross-section view taken along the line 3—3 of FIG. 2 both show the structural details of a preferred embodiment of recoil reduction system 8 of this invention. As shown in FIGS. 2 and 3, recoil reduction system 8 includes a plurality of chambers 9 that are uniformly spaced around the barrel 2 in the area of the breech of rifle 1. In FIG. 3 six chamber 9 are shown as being equally spaced across the bore 10 of barrel 2. As will become apparent, the exact number of chambers 9 provided is not critical and, therefore, more or less than six chambers can be provided. Further, as will become apparent, chambers 9 need not be uniformly spaced around bore 10 and need not totally surround bore 10.

A separate small channel or port 12 is associated with each of the chambers 9. Each channel or port 12 is cut through barrel 2 such that a passageway is formed between bore 10 and each of the chambers 9 by the channel or port 12 associated with that chamber 9. In other words, a separate passageway is formed between the bore and each chamber 9 by means of the channels or ports 12. A separate adjustable needle valve 11 extends into each chamber 9 such that the tip of each needle valve 11 is aligned with the channel or port 12 associated with that chamber 9. A separate hole is cut or drilled through the casing or housing 13 of recoil reducing system 8 into each of the chambers 9 and each hole is then conveniently threaded to receive its adjustable needle valve 11. Each of the channels 9 extend through housing or casing 13 at the breech end of casing or housing 13 but do not extend through housing or casing 13 at their opposite ends. The open end of each of the chambers 9 is sealed by means of a separate plug or seal 14. The plugs or seals 14 are conveniently threaded plugs with the inside of each chamber 9 being threaded a slight distance beyond its open end to receive a threaded plug 14. The threaded plugs 14 are provided to permit access to the inside of each chamber 9 for cleaning purposes.

As is shown in FIG. 2, the projectile 16 of shell 15 extends into bore 10 a slight distance beyond the channels or ports 12. Therefore, channels or ports 12 are covered by projectile 16 when shell 15 is loaded into rifle 1. When shell 15 is fired, projectile 16 is propelled down bore 10 away from the breech area of the rifle by the pressure exerted on projectile 16 due to the explosion of shell 15. The hot air and gasses due to the explosion of shell 15 are also propelled down bore 10. When projectile 16 moves down bore 10 away from channels or ports 12, channels or ports 12 are uncovered and some of the hot gasses will flow into each of the chambers 9 through channels or ports 12. When projectile 16 and the hot gasses are propelled out of the barrel by the pressure caused by the explosion of shell 15, a vacuum is formed in bore 15. That is, the pressure inside bore 10 caused by the explosion of shell 15 not only drives projectile 16 out of barrel 2 but also drives out all the gasses thereby creating a vacuum in bore 10. In prior art rifles that are not equipped with recoil system 8 of this invention, air due to atmospheric pressure rushes back into the bore and causes the weapon to recoil. The air rushes back into the bore rather rapidly since there is nothing in the bore to impede the flow of air and when the air rushing back into the bore impacts the back of the breech, the rifle recoils. In some ball and powder type weapons, the recoil due to this in-rush of air is rather violent.

When the pressure in bore 10 is less than the gas pressure of the hot gasses in chambers 9, which will be the case when bore 10 is evacuated, the hot gasses in chambers 9 will flow back into bore 10 through the ports 12 thereby increasing the pressure in bore 10. Thus, bore 10 is no longer evacuated. The gasses in chambers 9 do actually bleed out of the chambers before bore 10 becomes evacuated along its entire length. That is, when shell 15 is initially fired and projectile 16 moves past the channels or ports 10, the pressure behind projectile 16 is forced into chambers 9 through channels or ports 12. When the hot gasses travel toward the muzzle of barrel 2, a pressure gradient is formed in bore 10 such that the pressure is greater closer to the muzzle than at the breech end until the bore 10 is completely evacuated. As soon as the pressure in bore 10 in the vicinity of channels or ports 12 is less than the pressure in chambers 9, the hot gasses will bleed back into bore 10. In fact the hot gasses will actually be sucked back into bore 10 because of the pressure differential between chambers 9 and bore 10. Thus, a complete vacuum is never formed along the entire length of bore 10 since the hot gasses in chambers 9 begin to increase the pressure in bore 10 as soon as the pressure in bore 10 in the vicinity of channels or ports 12 is less than the pressure in chambers 9. In other words, the gasses in chambers 9 bleed back into bore 10 to in effect neutralize the vacuum in bore 10, thereby impeding the rapid flow of air back into bore 10 and also providing a cushion for the air that does flow back into bore 10. In this manner recoil reduction system 8 reduces the recoil in rifle 1 that is caused by air rushing back into bore 10. Further, it has been found that recoil system 8 also reduces the breech noise of rifle 1.

Summarizing the operation of recoil reduction system 8, hot gasses flow into chambers 9 through the channels or ports 12 when shell 15 is fired and projectile 16 uncovers channels or ports 12. As soon as the pressure in bore 10 drops below the pressure of the gasses in chambers 9 due to the fact that the projectile and hot gasses are being driven out of the bore, the gasses in chambers 9 flow back into bore 10 through channels or ports 12 to at least partially offset the vacuum in bore 10 that normally occurs in such a weapon to thereby impede the in-rush of air back into bore 10 and to provide a cushion for any air that does flow back into the barrel. In this manner recoil reduction system 8 neutralizes to a considerable extent the major cause of recoil in rifle 1 and, therefore, substantially reduces the recoil that normally occurs when such a weapon is fired. Recoil reduction system 8 also reduces the breech noise of rifle 1. This reduction in breech noise takes place due to the fact that recoil reduction system 8 eliminates the violent impact of air against the back of the breech that normally occurs when air rushes back into the bore of a rifle not equipped with recoil reduction system 8.

The flow of gasses into and out of chambers 9 can be controlled by adjustable needle valves 11. The point of each needle valve 11 is aligned with its associated channel or port 12. Thus, as can be seen from FIGS. 2 and 3, the space or passageway between the point of each adjustable needle valve and its associated channel or port 12 can be varied by adjusting each needle valve inward or outward, thereby controlling the flow of gasses into and out of each chamber. Each needle valve 11 is conveniently provided with a slotted head so that a screw driver can be used to readily adjust the depth of penetration of each needle valve into chamber 9. The plugs 14 at the open ends of chambers 9 are threaded plugs and are also conveniently provided with a slotted head so that they can readily be removed or reinserted from their respective chambers 9 by means of a screw driver. Of course, either or both needle valves 11 and plugs 14 could be provided with sockets, thereby requiring the use of an allen wrench. In fact, adjustable needle valves 11 and plugs 14 can be provided with any known head configuration that will facilitate adjustment of needle valve 11 and insertion or removal of plugs 14. Further, plugs 14 need not be made removable but are preferably removable so that access can be obtained to chambers 9 to permit cleaning of chambers 9. Chambers 9 will get dirty from the hot gasses just as the bore of a weapon becomes dirty. In addition, channels or ports 12 are accessible for cleaning purposes by the removing of adjustable needle valves 11.

In FIGS. 1, 2 and 3, recoil reduction system 8 is shown as completely surrounding barrel 2 of rifle 1. This will, of course, require properly designed rear and front sights. However, one skilled in the art would readily know what type of sights are needed and would know how to adjust these sights. Further, recoil reduction system 8 need not completely surround barrel 2. For example, if the upper most chamber 9 is the one at the top rifle 1, a pie-shaped wedge cut out of recoil reduction system 8 thereby removing this chamber would leave the top of barrel 2 unobstructed by recoil reduction system 8 and, therefore, any regular sights could be used. This, of course, would result in one less chamber 9; however, as previously stated, the exact number of chambers provided is not critical and any number can be provided. To operate in a satisfactory manner, however, not less than two chambers 9 should be provided and preferably not less than four. In addition, while recoil reduction system 8 is shown as being cylindrical in shape, the outside of recoil reduction system 8 can have any desired shape. For example, instead of being cylindrical shaped, recoil reduction system 8 could have an overall rectangular shape, or for that matter an irregular shape.

In the drawings, recoil reduction system 8 is shown as being an integral part of the barrel structure. If recoil reduction system 8 is incorporated into the rifle when it is manufactured, recoil reduction system 8 is conveniently added as an integral part of the barrel structure. However, recoil reduction system 8 can be manufactured as an add-on that would be secured to the barrel structure by any appropriate well known technique. In this manner recoil reduction system 8 can be added to any exciting rifle. Therefore, the use of recoil reduction system 8 is not limited to newly manufactured weapons.

FIG. 1 specifically shows a rifle and FIGS. 2 and 3 specifically relate to recoil reduction system 8 as used with rifle 1 of FIG. 1. However, as previously stated, recoil reduction system 8 can be used in any ball and power type weapon such as rifles, guns, cannons and the like and recoil reduction system 8 will have the same structure shown in FIGS. 2 and 3 for all types of ball and powder type weapons, except of course for size. In a cannon, the overall size of recoil reduction system 8 will be larger in size than the overall size of the structure used in a small hand gun or rifle. Therefore, while FIGS. 2 and 3 specifically show recoil reduction system 8 used with a rifle, it is to be remembered that FIGS. 2 and 3 also illustrate the incorporation of recoil reduction system 8 into any ball and powder type weapon. The only difference being the overall shape of the weapon with no difference in the basic structure or operation of recoil reduction system 8.

From the foregoing description of recoil reduction system 8, it is apparent that this invention compensates for the major cause of recoil in a ball and powder type weapon. As mentioned recoil reduction system 8 also reduces breech noise. However, recoil reduction system 8 provides some additional advantages that may not be apparent from the foregoing description. For example, in a shoulder held rifle, some of the recoil is absorbed by the weight of the rife. Therefore with recoil reduction system 8, the overall weight of a rifle can be reduced. This also holds true for cannons and other ball and powder type weapons. The recoil of a cannon caused by the air rushing back into the bore is in many cannons quite violent and the overall weight plus the mount for the cannon must be able to withstand the violent shock. With recoil reduction system 8, the weight of the cannon can be reduced and the weight of the cannon mount can be reduced and the design can be simplified. Further, recoil reduction system 8 does not materially affect the breech pressure of the weapon; therefore, the range of a weapon is not reduced by recoil reduction system 8. In addition, other conventional recoil reduction systems such as a muzzle brake can be used in combination with recoil reduction system 8 to provide a ball and powder type weapon that is almost totally recoiless. From the foregoing discussion, it should be apparent that recoil reduction system 8 not only counters the major cause of recoil in a ball and powder type weapon to thereby substantially reduce recoil but also provides additional advantages.

While the invention is shown and described with reference to a specific embodiment, it will be obvious to those skilled in the art that changes and modifications other than those specifically mentioned herein can also be made to this specific embodiment without departing from the spirit and scope of the invention as set forth in the claims.

I claim:

1. A recoil reduction system for ball and powder type weapons comprising:

a plurality of gas storage chambers surrounding at least a part of the barrel structure of a ball and powder type weapon in the area of the breech of said ball and powder type weapons, each one of said plurality of gas storage chambers being cylindrical in shape and being so positioned that the axis of each said cylindrical shaped gas chamber is parallel with the axis of said breech;

a plurality of narrow channels equal in number to said plurality of gas storage chambers, a different one of said plurality of narrow channels forming a passageway between each one of said plurality of gas storage chambers and the bore of said ball and powder type weapon, said narrow channels being so located that each one of said plurality of narrow channels communicates with said bore in said breech area of said ball and powder type weapon but in front of the area of said breech in which the powder of said ball and powder is located, whereby gases from said bore will, after said ball and powder type weapon is fired, flow through said plurality of narrow channels into said plurality of chambers and out of said plurality of chambers back into said bore when the pressure in said bore is less than the pressure in said plurality of chambers; and a plurality of adjustable needle valves equal in number to said plurality of chambers, each one of said adjustable needle valves having a point at one end, a different one of said plurality of adjustable needle valves extending into each one of said plurality of gas storage chambers such that said point on said one end of each of said plurality of adjustable needle valves is aligned with the said narrow channel of said plurality of narrow channels associated with the said gas storage chamber into which that adjustable needle extends, each one of said needle valves being continuously and independently adjustable.

2. A recoil reduction system as defined in claim 1 wherein each one of said plurality of gas storage chambers is open at one end and wherein a plurality of removable plugs equal in number to said plurality of gas storage chambers is provided, a different one of said plurality of plugs being secured in said open end of each one of said plurality of gas storage chambers.

* * * * *